US007142105B2

(12) United States Patent
Chen

(10) Patent No.: US 7,142,105 B2
(45) Date of Patent: Nov. 28, 2006

(54) FIRE ALARM ALGORITHM USING SMOKE AND GAS SENSORS

(75) Inventor: Shin-Juh Chen, Santa Fe, NM (US)

(73) Assignee: Southwest Sciences Incorporated, Santa Fe, NM (US)

( * ) Notice: Subject to any disclaimer, the term of this patent is extended or adjusted under 35 U.S.C. 154(b) by 0 days.

(21) Appl. No.: 11/056,811

(22) Filed: Feb. 10, 2005

(65) Prior Publication Data

US 2005/0200475 A1 Sep. 15, 2005

Related U.S. Application Data

(60) Provisional application No. 60/543,647, filed on Feb. 11, 2004.

(51) Int. Cl.
*G08B 19/00* (2006.01)

(52) U.S. Cl. ..... 340/521; 340/628; 340/632

(58) Field of Classification Search ..... 340/521, 340/628, 632, 630, 578, 587, 522; 250/343, 250/339.03, 339.15
See application file for complete search history.

(56) References Cited

U.S. PATENT DOCUMENTS 5,445,160 A * 8/1995 Culver et al. ..... 600/532
5,506,577 A * 4/1996 Doyle ..... 340/870.01
5,592,147 A 1/1997 Wong
5,644,294 A * 7/1997 Ness ..... 340/540
5,691,703 A 11/1997 Roby et al.
5,691,704 A 11/1997 Wong
5,767,776 A 6/1998 Wong
5,798,700 A 8/1998 Wong
5,912,624 A * 6/1999 Howard, II ..... 340/632
5,936,532 A 8/1999 Peralta
5,945,924 A 8/1999 Marman et al.
5,966,077 A 10/1999 Wong
6,107,925 A 8/2000 Wong
6,154,284 A * 11/2000 McAndrew et al. ..... 356/437
6,166,647 A 12/2000 Wong
6,426,703 B1 7/2002 Johnston et al.

OTHER PUBLICATIONS

Blake, David , "Aircraft Cargo Compartment Smoke Detector Alarm Incidents on the U.S.-Registered Aircraft, 1974-1999", *Department of Transportation, Federal Aviation Administration: DOT/FAA/AR-TN00/29*, (Jun. 2000), 1-10.
Bomse, David S., et al., "Frequency Modulation and Wavelength Modulation Spectroscopies: Comparison of Experimental Methods Using a Lead-Salt Diode Laser", *Applied Optics*, vol. 31, No. 6, (Feb. 1992),718-731.
Chapra, Steven C., "Numerical Methods for Engineers", Chapter 11, McGraw-Hill,(1988),330-338.
Gottuk, Daniel T., et al., "Advanced Fire Detection Using Multi-Signature Alarm Algorithms", *Fire Safety Journal*, vol. 37, (2002),381-394.

(Continued)

*Primary Examiner*—Anh V. La
(74) *Attorney, Agent, or Firm*—Jeffrey D. Myers; Peacock Myers, P.C.

(57) ABSTRACT

An apparatus for and method of detecting fires comprising detecting (with one or more detectors) levels of carbon monoxide, carbon dioxide, and smoke in an ambient environment, computing (using a processor) over time rates of increase of each of the levels, and generating an alarm if one or more of the rates of increase exceed predetermined threshold rates of increase.

26 Claims, 7 Drawing Sheets

OTHER PUBLICATIONS

Hagen, Bjarne C., et al., "The Use of Gaseous Fire Signatures as a Mean to Detect Fires", *Fire Safety Journal*, vol. 34, (2000),55-67.
Herriott, Donald R., et al., "Folded Optical Delay Lines", *Applied Optics*, vol. 4, No. 8, (Aug. 1965),883-889.
Herriott, D. R., et al., "Off-Axis Paths in Spherical Mirror Interferometers", *Applied Optics*, vol. 3, No. 4, (Apr. 1964),523-526.
Kaiser, Thomas , et al., "Temperature Fluctuation as a Detection Criterion", *Fire Safety Journal*; vol. 29, (1997),217-226.
McManus, J. B., et al., "Astigmatic Mirror Multipass Absorption Cells for Long-Path-Length Spectroscopy", *Applied Optics*, vol. 34, No. 18, (Jun. 1995),3336-3348.
Milke, James A., "Monitoring Multiple Aspects of Fire Signatures for Discriminating Fire Detection", *Fire Technology*, vol. 35, (Aug. 1999), 195-209.
Rose-Pehrsson, Susan L., et al., "Real-Time Probabillistic Neural Network Performance and Optimization for Fire Detection and Nuisance Alarm Rejection", *12th Intl Conf on Automatic Fire Detection*, (Mar. 2001).
Silver, Joel A., "Applied Optics, vol. 31, No. 6Frequency-Modulation Spectroscopy for Trace Species Detection: Theory and Comparison Among Experimental Methods", *Applied Optics*, vol. 31, No. 6, (1992),707-717.
Sivathanu, Y. R., et al., "Fire Detection Using Time Series Analysis of Source Temperatures", *Fire Safety Journal*, vol. 29, (1997),301-315.
White, John U., "Long Optical Paths of Large Aperture", *Journal of Optical Society American*, vol. 32, (1942),285-288.

* cited by examiner

FIRE ALARM ALGORITHM USING SMOKE AND GAS SENSORS

CROSS-REFERENCE TO RELATED APPLICATIONS

This application claims the benefit of the filing of U.S. Provisional Patent Application Ser. No. 60/543,647, entitled "Fire Alarm Algorithm Using Smoke and Gas Sensors," filed on Feb. 11, 2004, and the specification thereof is incorporated herein by reference.

STATEMENT REGARDING FEDERALLY SPONSORED RESEARCH OR DEVELOPMENT

The U.S. Government has a paid-up license in this invention and the right in limited circumstances to require the patent owner to license others on reasonable terms as provided for by the terms of Contract No. NAS3-01125, awarded by the U.S. National Aeronautics and Space Administration.

INCORPORATION BY REFERENCE OF MATERIAL SUBMITTED ON A COMPACT DISC

Not Applicable.

COPYRIGHTED MATERIAL

Not Applicable.

BACKGROUND OF THE INVENTION

1. Field of the Invention (Technical Field)

The present invention relates to the detection of fires in closed compartments such as aircraft cargo bays and buildings using fire alarm algorithms and sensors for monitoring fire signatures.

2. Description of Related Art

Fire signatures for flaming and smoldering fires have included temperature, smoke, and chemical species. The chemical species may include oxygen ($O_2$, hereafter O2), carbon monoxide (CO), carbon dioxide ($CO_2$, hereafter CO2), water vapor ($H_2O$, hereafter H2O), nitric oxide (NO), hydrogen cyanide (HCN), acetylene ($C_2H_2$, hereafter C2H2), etc. Fire alarm algorithms based on fire signatures are developed using intuition (e.g., threshold and rate of increase), systematic methods (i.e,. involving mathematical formula), and variable methods (e.g., artificial neural network). Simple algorithms are based on thresholds for maximum values, rates of increase, and combinations thereof.

Fire detection systems of current aircraft cargo compartments are primarily smoke detectors. The false alarm rates, defined as the percentage of alarms with no verified smoke in the cargo compartment, are as high as 99 percent. The cost of a false alarm is estimated between $30,000 to $50,000 per incident (D. Blake., "Aircraft cargo compartment smoke detector alarm incidents on U.S.-registered aircraft, 1974–1999, DOT/FAA/AR-TN00/29, 2000). Moreover, regulations mandate that the alarm sounds within one minute after the onset of a fire condition. Pilots may have only about ten to fifteen minutes in which to land before smoke or damage to the structure from an uncontained fire prevents the pilot from controlling the aircraft. Reducing the time to alarm will allow pilot to suppress the fire at an earlier stage and permit more time to land the aircraft safely.

Several fire detection systems have been developed to reduce false alarms and decrease the time response of smoke detectors. Several approaches have been taken to improve the performance of smoke detectors. Other detection systems have taken a totally different approach to fire detection.

J. A. Milke, "Monitoring multiple aspects of fire signatures for discriminating fire detection," *Fire Technology* 35, 195–209 (August 1999), uses a pair of CO and CO2 detectors to identify flaming and non-flaming fires. Flaming fires is detected by the CO2 threshold concentration or rate of increase. Non-flaming fire is detected by the rate of increase of CO or CO2. Reduction in false alarms and detection times were observed when compared to a commercial smoke detector.

D. T. Gottuk, et al., "Advanced fire detection using multi-signature alarm algorithms," *Fire Safety Journal* 37, 381–394 (2002), use a fire alarm algorithm based on the product of CO absolute concentration and smoke obscuration level. Results have shown improvements over both ionization and photoelectric smoke detectors alone in terms of reduction in nuisance alarms and response times.

B. C. Hagen, et al., "The use of gaseous fire signatures as a mean to detect fires," *Fire Safety Journal* 34, 55–67 (2000), use a fire detection system comprising two Taguchi sensors (820 and 822), two gas sensors (CO and CO2), and temperature. The fire alarm algorithm uses threshold values to classify flaming fire (when CO2>210 ppm and temperature>40° C.), smoldering fire (when CO>17 ppm, and CO2>22 ppm, and Taguchi 822>0.270V), and nuisance sources (when Taguchi 822>0.9V and Taguchi 880>0.15V). This combined system was found to perform better than two smoke detectors without introducing additional false alarms.

S. L. Rose-Pehrsson, et al., "Real-time probabilistic neural network performance and optimization for fire detection and nuisance alarm rejection," 12$^{th}$ *International Conference on Automatic Fire Detection* (March 2001), use ionization and photoelectric detectors, CO and CO2 sensors using magnitude and slope information, and background subtraction to evaluate a fire alarm algorithm based on probabilistic neural network. Flaming fires were identified correctly, but smoldering fires were problematic.

T. Kaiser, et al., "Temperature fluctuation as a detection criterion," *Fire Safety Journal* 29, 217–226, (1997) use a fire detector based on temperature fluctuations to provide an additional criterion for fire detection.

Y. R. Sivathanu, et al., "Fire detection using time series analysis of source temperatures," *Fire Safety Journal* 29, 301–315 (1997), have shown that power spectral density and the probability density function of the source temperatures are be sufficient to determine the presence of a fire in the vicinity of the detector.

R. J. Roby, "Multi-signature fire detector," U.S. Pat. No. 5,691,703 (1997), uses two sensors or detectors to detect two different signatures, and their outputs are compared to predetermined values or combined in a sum or a product which is compared to predetermined reference values. In the case of the sum, the outputs can be multiplied by a weighting coefficient prior to adding the outputs. Smoke and CO are used to evaluate this invention.

J. Y. Wong, "False alarm resistant fire detector with improved performance," U.S. Pat. No. 5,798,700 (1998), is a continuation of U.S. Pat. No. 5,592,147 (1997). The invention uses a smoke and CO2 sensors to generate a fire alarm when both CO2 and smoke exceed threshold values at the same time, or the rate of increase of CO2 exceeds a predetermined threshold rate.

D. A. Peralta, "Smoke and carbon monoxide detector with clock," U.S. Pat. No. 5,936,532 (1999), combined a smoke detector with a CO detector for residential use. When the presence of smoke or CO is detected, an alarm is initiated. Capability is provided to manually de-activate the annunciator in case of false alarms. The annunciator is then automatically re-activated after a predetermined time interval.

D. H. Marman, et al., "Fire and smoke detection and control system", U.S. Pat. No. 5,945,924 (1999), use a fire alarm algorithm based on the rate of change of CO2 and/or smoke. The algorithm has shown reduction in nuisance alarms and response times. The rate of change of CO2 was specified in parts per million per minute (ppm/min).

J. Y. Wong, "Fire detector," U.S. Pat. No. 5,966,077 (1999), is a continuation of U.S. Pat. No. 5,691,704 (1997) and U.S. Pat. No. 5,767,776 (1998). The invention combines a CO2 detector and a smoke detector to detect the presence of a fire when CO2 rate of increase exceeds a first predetermined level and smoke exceeds a predetermined level, or when the rate of increase of CO2 exceeds a second predetermined rate.

J. Y. Wong, "Method for dynamically adjusting criteria for detecting fire through smoke concentration," U.S. Pat. No. 6,107,925 (2000), uses CO2 measurements to dynamically adjust the smoke detector output signal fire detection criterion. The CO2 measurements are used to determine the probability of the existence of a fire.

J. Y. Wong, "Fire detector," U.S. Pat. No. 6,166,647 (2000), combines a smoke detector with an electronic nose that detects fire radicals to detect the presence of a fire. A fire alarm is initiated with the rate of increase of both the smoke and fire radicals exceed predetermined threshold rates.

D. S. Johnston et al., "Carbon monoxide and smoke detection apparatus," U.S. Pat. No. 6,426,703 (2002), combine a smoke detector and a CO sensor to make a fire alarm algorithm. Smoke and CO outputs are processed independently. When CO exceeds a predetermined limit, without the presence of smoke, alarm sounds.

The present invention improves on the art by using a fire detection system that comprises a smoke detector, a gas sensor for carbon dioxide, a gas sensor for carbon monoxide, and a fire alarm algorithm based on the rates of increase of these three fire signatures. Concentrations of CO and CO2 are usually expressed in parts per million (ppm) and smoke signal in Volt (V). These rates of increase are specified in parts per million per second (ppm/sec) for CO and CO2, and in V/sec for smoke. The decision to alarm is based on the condition when the smoke rate of increase is exceeded, and CO or CO2 rate of increase exceeds its predetermined threshold rate as well. The fire alarm algorithm provides a way to reduce or minimize false alarms generated by smoke detectors alone. Fire detection algorithm is interrogated once per second, offering a fast response to the detection of incipient fires. Furthermore, the algorithm is immune to signal offsets caused by background changes or sensor aging, and noises that are inherent in the measurements of smoke, CO and CO2.

BRIEF SUMMARY OF THE INVENTION

The present invention is of an apparatus for and method of detecting fires, comprising: detecting (with one or more detectors) levels of carbon monoxide, carbon dioxide, and smoke in an ambient environment; computing (using a processor) over time rates of increase of each of the levels; and generating an alarm if one or more of the rates of increase exceed predetermined threshold rates of increase. In the preferred embodiment, computing comprises computing moving averages of one or more of the levels over a time window. Computing preferably additionally comprises employing linear regression fitting and one or more of Fourier-transform infrared spectroscopy, non-dispersive infrared spectroscopy, electrochemical sensing, and diode laser spectroscopy. Diode laser spectroscopy is preferably used for detecting one or both of the levels of carbon monoxide and carbon dioxide, one or more multiple pass optical cells are employed, and one or more distributed feedback diode lasers and/or vertical cavity surface emitting lasers are employed. Carbon monoxide levels are preferably detected with a sensitivity of at least 5 ppm. One or both of carbon monoxide and carbon dioxide level detection employs least square fitting a measured spectrum to a model, most preferably a model including a quadratic background. Various alarm triggers can be employed depending on application, such as generating an alarm if two or more of the rates of increase exceed predetermined threshold rates of increase and generating an alarm if the rate of increase of smoke exceeds a predetermined threshold rate of increase and one or both of the other rates of increase exceeds the corresponding predetermined threshold rate of increase.

Objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

The present invention is of a method of and apparatus for a fire alarm algorithm based on the rates of increase of three fire signatures which are smoke, CO, and CO2. It is capable of detecting types of fires ranging from smoldering to flaming combustion, and providing immunity to nuisance sources. It can provide a fire detection system that can rapidly detect fires within seconds after its onset. It can drastically reduce or eliminate false alarms generated by smoke detectors operating alone. It can be applied to fire systems in any type of contained area, for example, for buildings, ship compartments, submarines, aircraft, compartments in spacecraft, concealed cavities used for running electrical wires and plumbing, and ventilation shafts.

Figure 1:
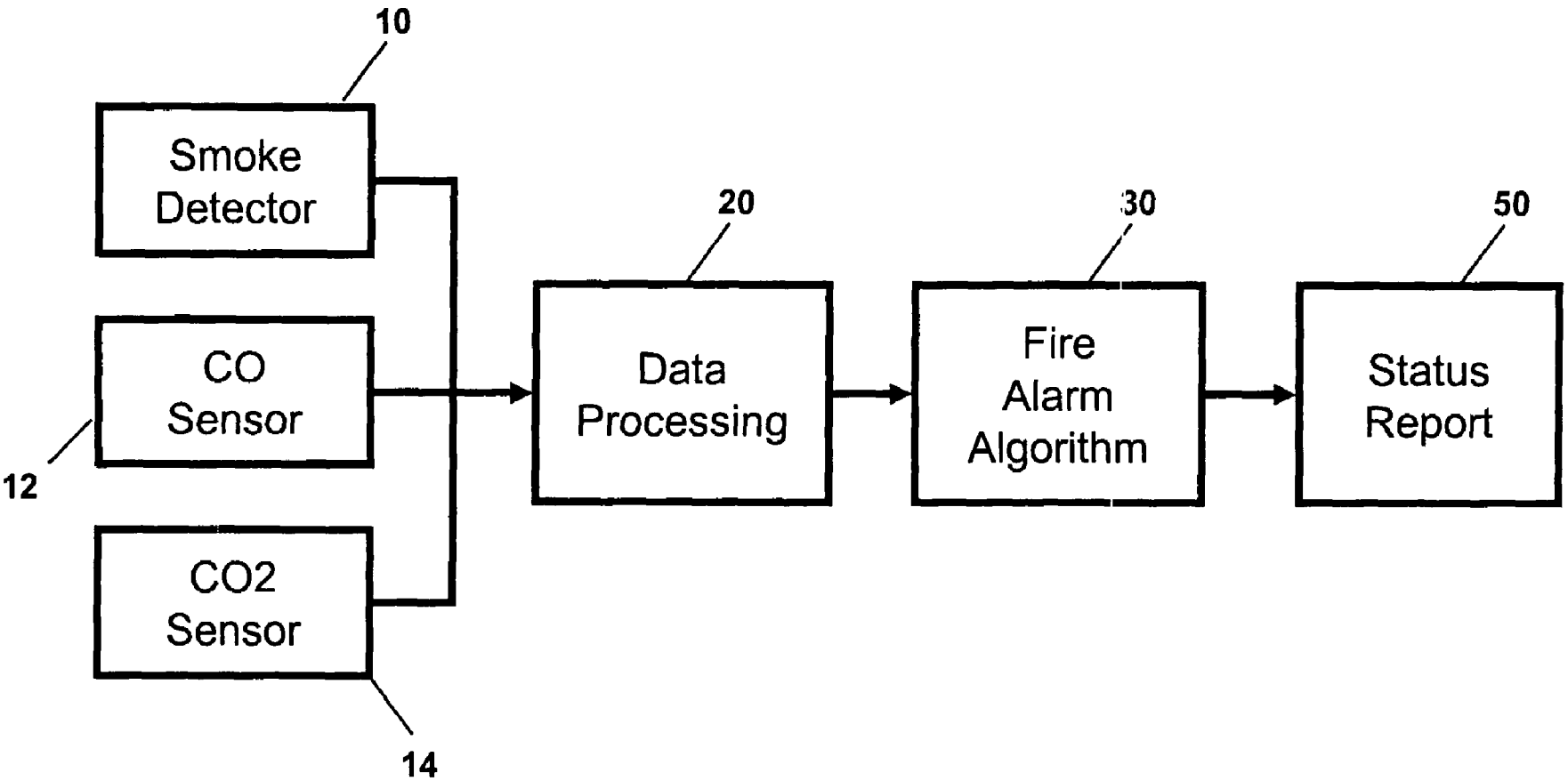
FIG. 1 is a schematic diagram of the fire detection system, namely a smoke detector, a CO sensor, a CO2 sensor, a data processing module, fire alarm algorithm module, and a status reporting module.
Figure 2:
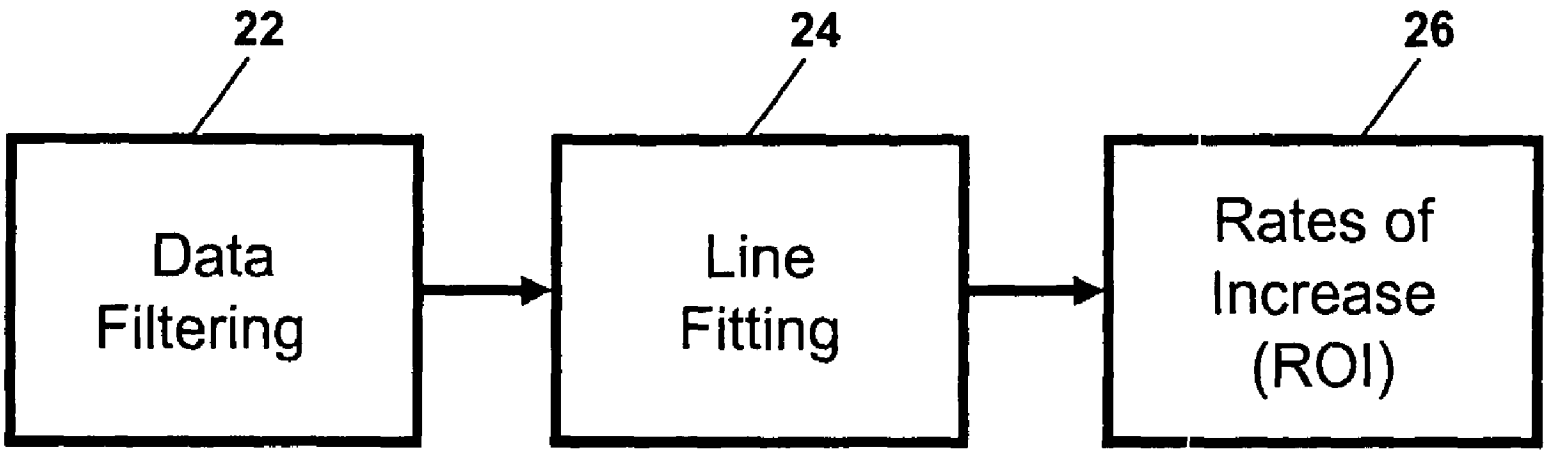
FIG. 2 is a schematic diagram of the data processing module of the fire detection system, namely data filtering, line fitting and computing the rates of increase.

The fire sensor system (FIG. 1) preferably comprises: one or more, but preferably three detectors, most preferably for CO 10, CO2 12, and smoke 14; data processing routines 20; fire alarm algorithms 30; and, means for displaying the fire status 50. The data processing module (FIG. 2) can incorporate data filtering schemes 22, line-fitting schemes 24, and methods to compute the rate of increase of fire signatures 26.

The invention preferably provides for filtering noisy data using a moving-average over a specified time window. A time window of 10 seconds is chosen here to illustrate the data filtering scheme. When the data acquisition software is initially started, the first ten points are all new data. In subsequent times, the first nine points will be from previous times, and only the $10^{th}$ point is the new datum at the current time. For each data point within the specified time window, an average is computed using the data point of interest and its previous nine data points. This data filtering method will further smooth the fluctuations seen in the data. The method works best when the natural background fluctuations of the chemical species are small. Using a long averaging time makes the sensor's white noise smaller, thus possibly permitting the use of much lower thresholds than a method that uses raw data. When the natural background fluctuations are resolved, there is no advantage in using longer averaging times, since the thresholds cannot be further reduced without causing false alarms.

Figure 3A:
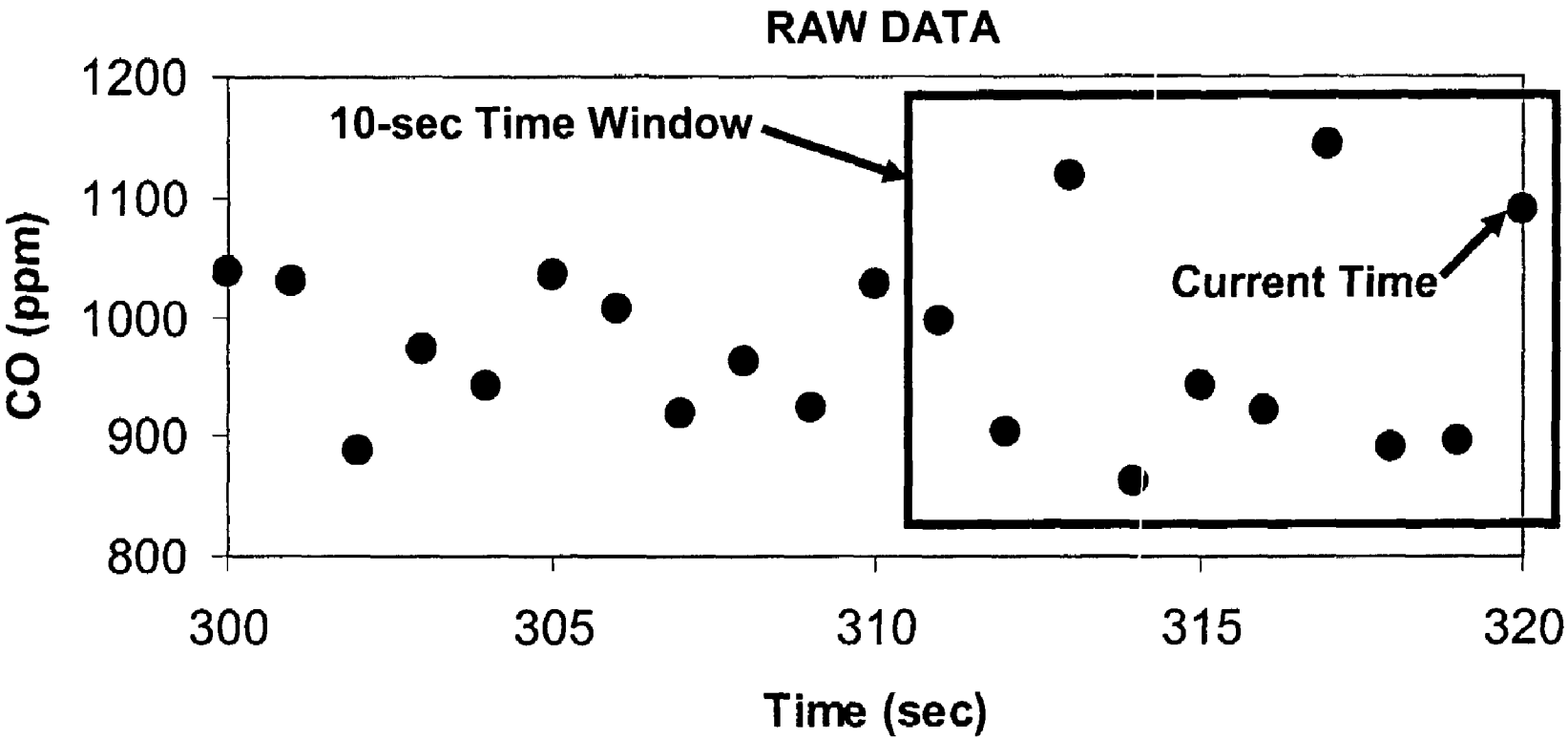
FIG. 3*a* is a plot of experimental data showing the concentration of CO in ppm versus time.
Figure 3B:
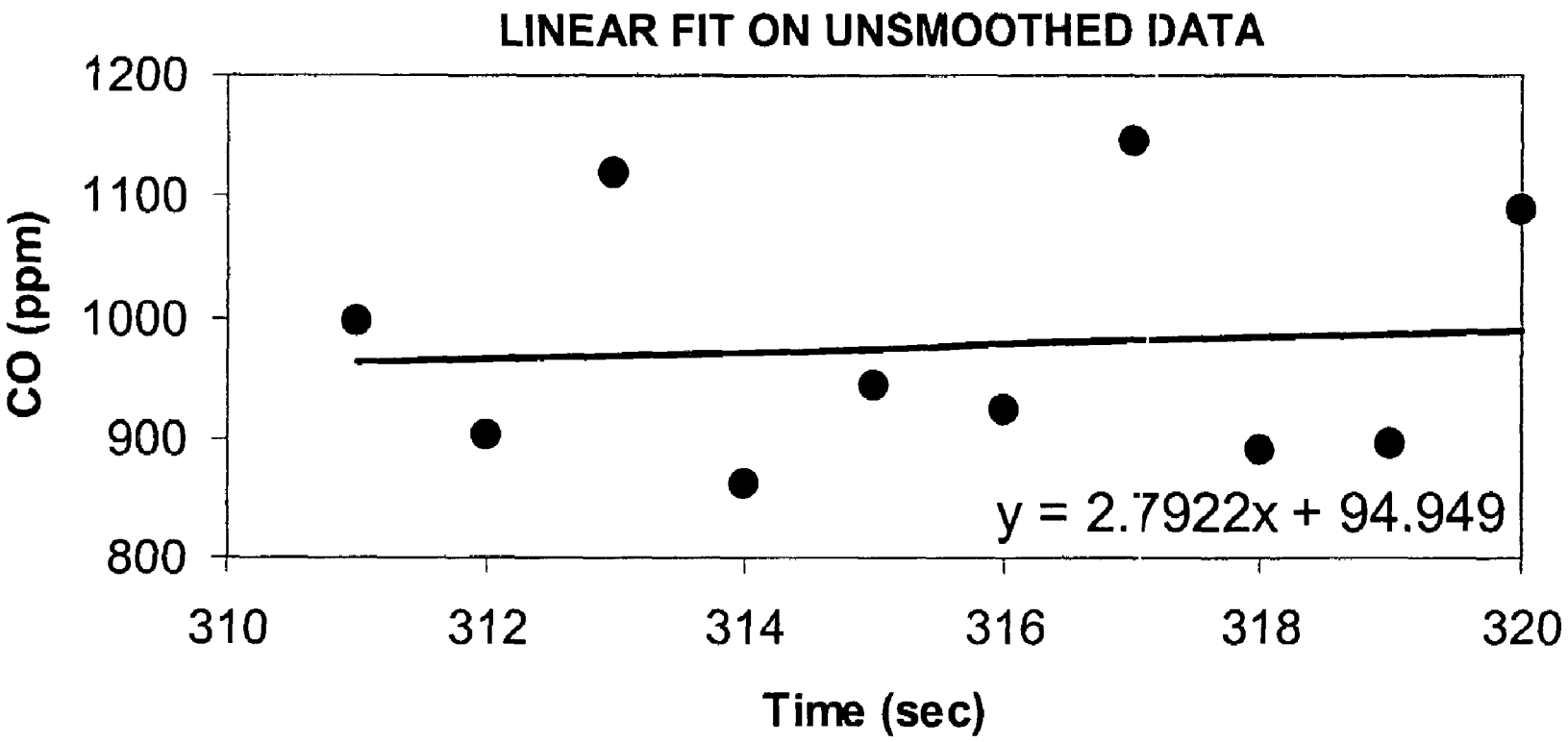
FIG. 3*b* is a plot of experimental data within the 10-sec time window with a linear curve fit.
Figure 3C:
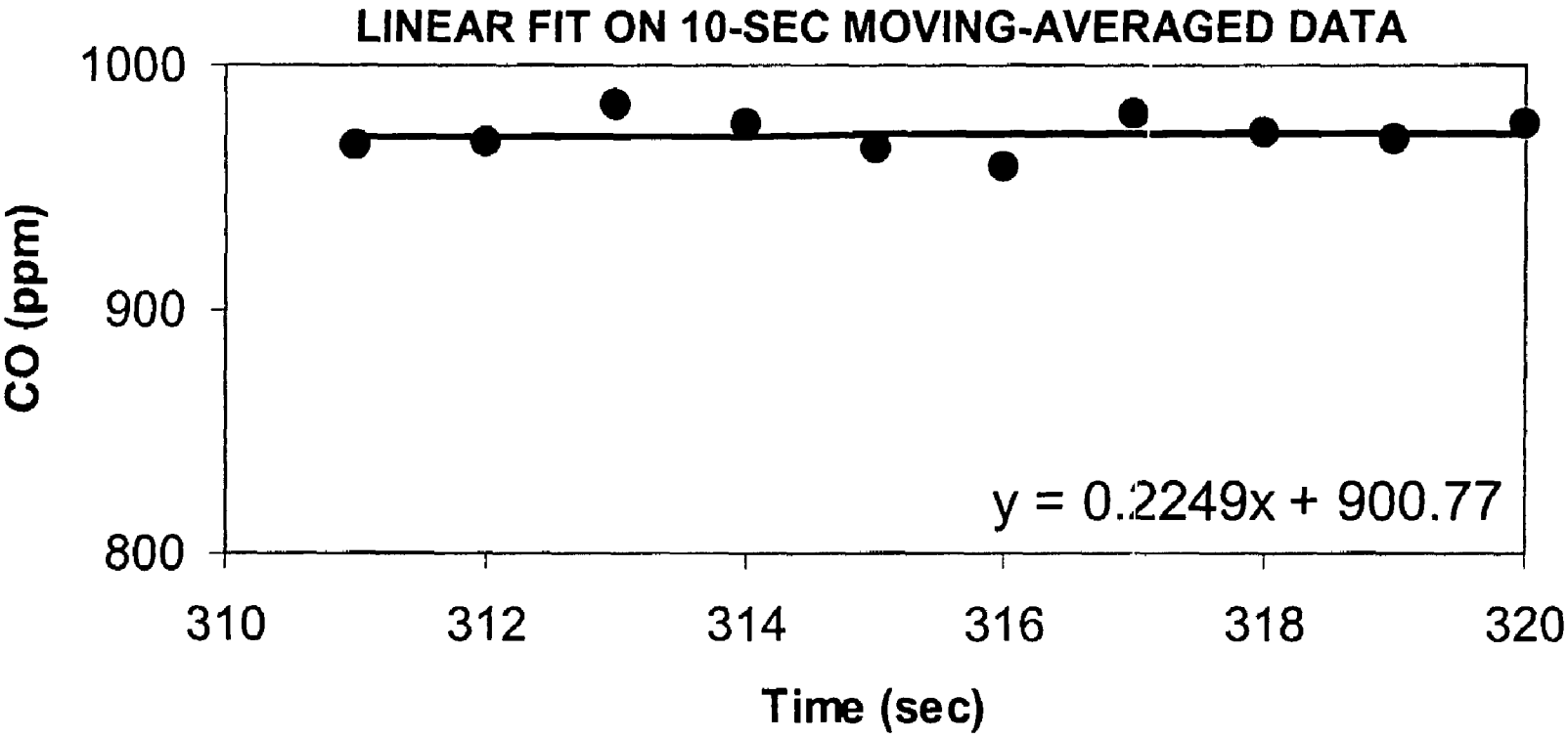
FIG. 3*c* is a plot of 10-sec moving-averaged experimental data within the 10-sec time window with a linear curve fit.
Figure 4:
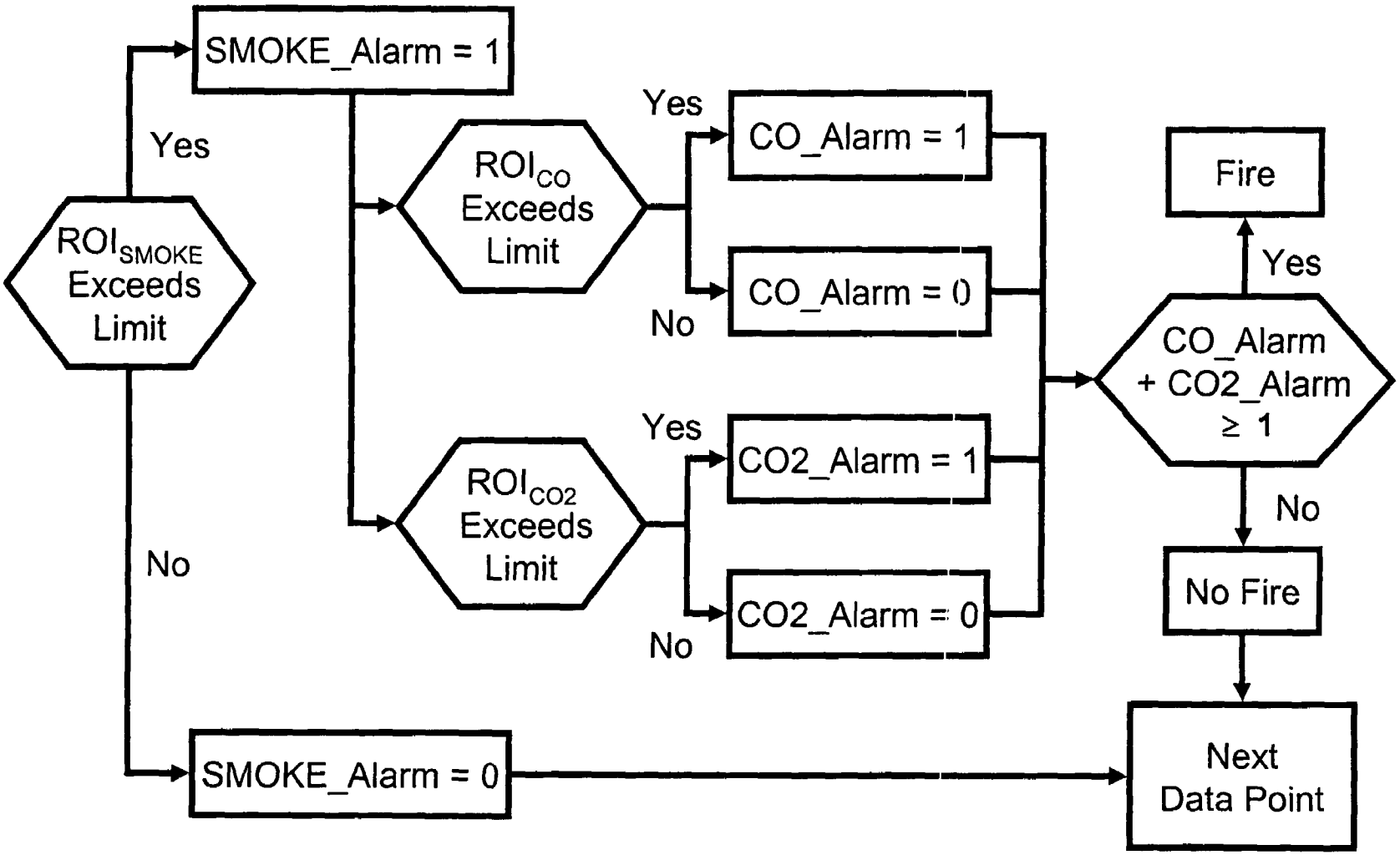
FIG. 4 is a schematic diagram of the decision tree used in the preferred embodiment fire alarm algorithm of the fire detection system to determine whether or not a fire scenario is present in the environment being monitored. If the smoke rate of increase exceeds its predetermined threshold rate, then the rate of increase of CO and CO2 are checked as well. If either CO or CO2 rate of increase exceeds its predetermined threshold rate, then a fire alarm is activated.
Figure 5:
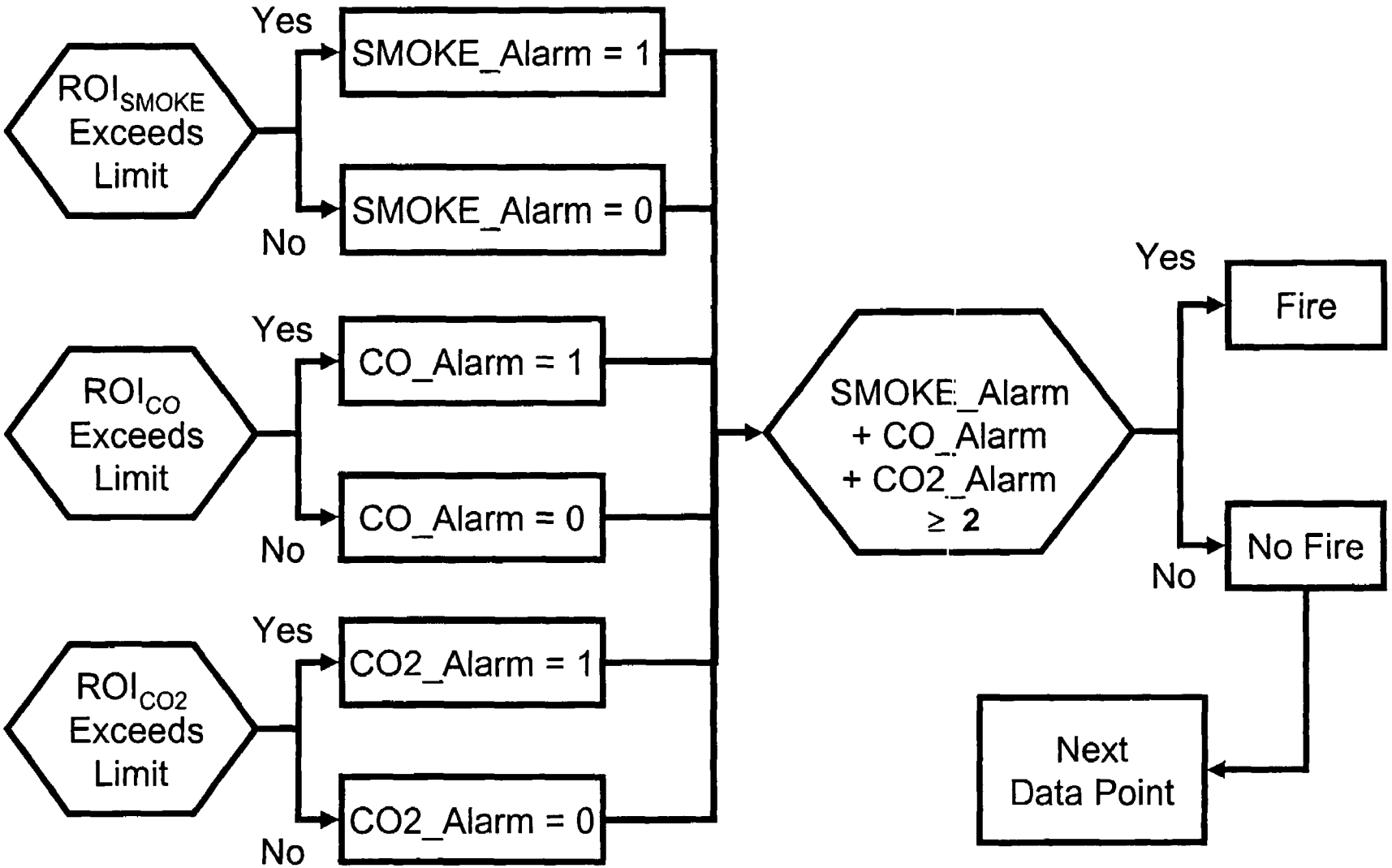
FIG. 5 is a schematic diagram of the decision tree used in the alternative preferred embodiment of the fire alarm algorithm of the fire detection system to determine whether or not a fire scenario is present in the environment being monitored. If any of the two fire signatures (i.e. smoke, CO, and CO2) exceeds their predetermined threshold rates, then a fire alarm is activated

In addition, the invention preferably provides for computing the rates of increase of the fire signatures, most preferably using a linear regression fitting scheme. Sample experimental data for burning HDPE is shown in FIG. 3*a* with the data points within the 10-sec time window boxed. The unsmoothed data points (FIG. 3*b*) or moving-averaged data points (FIG. 3*c*) within the specified time window is fitted with a straight line using linear regression. The slope of this straight line is simply the time derivative of the fire signature been measured, and corresponds to the rate of increase of the corresponding parameter in the analysis. A simple linear regression method (S. C. Chapra, *Numerical Methods for Engineers* ch. 11, McGraw-Hill 1988) can be used. The temporal derivative is related to the first temporal derivative of the line fit. Alarm algorithms based on maximum values are highly sensitive to signal offsets (due to background concentrations), demand measurements of high accuracy, and require accurate and frequent calibrations. Alarm algorithms based on the rates of increase do not share these complexities.

Furthermore, the invention preferably provides a method and apparatus for measuring concentrations of carbon dioxide and carbon monoxide in a fire, most preferably accomplished using a diode laser spectrometer. Optical absorption with wavelength modulation spectroscopy (J. A. Silver, "Frequency Modulation spectroscopy for trace species detection: theory and comparison," *Appl. Opt.* 31, 707–717, 1992; and, D. S. Bomse, et al., "Frequency modulation spectroscopy for trace species detection: experimental comparison of methods," *Appl. Opt.* 31, 718–731, 1992) is preferably utilized to measure simultaneously concentrations of carbon dioxide and carbon monoxide. The present invention preferably employs three fire signatures (smoke, CO and CO2) which are combined in the fire alarm detection method of the invention. The same method can be applied to CO and CO2 measurements obtained by other means, including, Fourier-transform infrared spectroscopy (FTIR), non-dispersive infrared spectroscopy (NDIR), electrochemical sensors, or any other measurement methods that can provide time rate of change of species concentrations.

An optical absorption method for detecting gaseous chemical species preferred for the invention preferably comprises a diode laser which can be tuned in wavelength by adjusting its temperature and injection current, electronics to control the current and temperature of the laser, optics for collimating and directing the laser beam, an electrical ramp generator which ramps the current and thereby ramps the laser beam's wavenumber, an optional beam splitter, at least one detector capable of responding to the diode laser radiation, a reference cell for self-checking the laser operation (i.e. line-locking), a multiple pass optical cell for high-sensitivity optical absorption measurements, an optional background subtraction circuit, optional amplifiers, an analog to digital converter, and a computer or digital signal processor for analyzing the spectrum and storing or displaying the analyte concentration. These multiple-pass cells can be based on the designs of D. R. Herriott, et al., "Off-axis paths in spherical mirror interferometers," *Appl. Opt.* 3, 523–526, 1964; J. U. White, *J. Opt. Soc. Am.* 32, 285, 1942; astigmatic cells by D. R. Herriot, et al., "Folded optical delay lines," *Appl. Opt.* 4, 883–889, 1965, and by J. B. McManus, et al., "Astigmatic mirror multipass absorption cells for long-path-length spectroscopy," *Appl. Opt.* 34, 3336–3348, 1995.

The diode laser module of the optical absorption method is preferably a distributed feedback (DFB) diode laser that operates at a nominal room temperature wavelength of 1565.5 nm. While the bands of CO and CO2 both contain numerous strong lines, in fact overlap of the lines with each other or with water vapor lines reduces the number of useful measurement regions to just the pair selected at 1566.6 nm (6383 $cm^{-1}$). The laser is preferably stabilized at 32° C. using a thermoelectric cooler to access this absorption line. The two absorption lines are accessible by scanning the laser wavelength only less than one wavenumber ($cm^{-1}$); this tunning range is certainly within the capability of a DFB laser. The two lines overlap over a region that covers ⅓ $cm^{-1}$. As longer wavelength (around 2.3 microns) lasers become available, other wavelengths can be used to measure CO and CO2 using either a single or a pair of lasers to access individual absorption lines. The wide tunability afforded by vertical cavity surface emitting lasers (VCSELs) could make the selection of potential line pairs an easier task.

The multiple pass optical cell preferred for the optical absorption method of the invention is used to obtain the needed sensitivity of about 5 ppm for CO. This Herriott-type cell comprises two mirrors, one flat and one concave, mounted in a tube and separated by a distance that is proportional to the focal length of the concave mirror. The separation distance between the two mirrors of 31.8 cm must be accurate to 1 mm or 0.3 percent. The total optical path length is about 20-m long with 32 spots in a circular pattern on each mirror. Inlet and outlet holes are needed for flowing sampled gas in and out of this tube. This large number of passes is achieved by using a 5-cm mirror diameter. Other variations of this multiple pass optical cell can be used to further increase the total optical path length, such as increasing the number of laser spots by using larger diameter mirrors, and increasing the separation distance between the two mirrors.

Standard wavelength modulation techniques are implemented to additionally improve the measurement sensitivity. The modulation frequency, f, is 250 kHz, and the demodulation is at twice this frequency, 2 f, resulting in a change of line shape that resembles the second derivative of the absorption spectrum. Spectra are acquired by ramping the laser current over a 1 $cm^{-1}$ range. A main computer program loops call routines that collect and co-average approximately 1000 spectra each second. Spectra of 50 ppm of CO and 1 percent CO2 were acquired to determine the appropriate least-square fitting basis functions. The concentration of CO and CO2 in the measurement path is found by least-square fitting the measured 2 f spectrum to a model that includes a quadratic background. The gas concentrations and the reference peak location are updated once per second.

A commercial aircraft smoke detector was used to measure smoke concentrations to demonstrate the invention. An analog output was available for data acquisition. This output is labeled "factory test" and can only be used with a high impedance probe. Smoke concentration is reported in Volts once a second, which corresponds to the level of light attenuation per meter. The factory setting for fire alarm is 5 Volts which corresponds to 15 percent per meter attenuation. The noise level is 0.0002 V for a 10-second averaging time. The rate of increase of smoke concentration is used in the fire alarm algorithm as well. The fire alarm set point of 5 Volts was not used in the fire alarm algorithm, but it was used only to compare the performance of the present invention and that of a smoke detector operating alone. This specific smoke detector is used here only for the purpose of demonstrating the performance of the present invention.

Noise in the measurements contributes noise in the temporal derivatives of concentrations. Using a long history window, t, reduces the scatter in the measured derivatives by $t^{3/2}$. However, it takes a longer time for the computed derivatives to reach the ideal slope of noiseless signal. In fact, for a smoke or gas signal that abruptly begins to increase with a constant slope, the time to reach the ideal slope value is given by the length of history window. For the system to alarm reliably, the smoke and gas derivative signals should reach some multiple of the noise, for instance, five standard deviations. The rates of rise for CO, CO2 and smoke, for the case of unfiltered data, were obtained empirically using results from a heptane fire and set to the following threshold rates, 0.15 ppm/sec, 25 ppm/sec, and 0.001 Volt/sec, respectively. These rates of increase can change depending on the operating environment and the method of gas sample delivery to the fire detection system.

A moving-average over a specified time window provides a faster means of reducing the random noise present in the measurements. Moving-averages with time window having lengths of 10, 15, and 20 seconds were used to demonstrate the dependence of the standard deviations on the length of the time window. The standard deviations were computed over a time interval of 180 seconds for each of the time window lengths. The time to alarm is shown to be proportional to $t^a$, where a is approximately between 5/10 and 6/10. Faster, more reliable alarms can be obtained by using a long time window, particularly for the weakest signals of smoldering fires. A time window length of just 10 seconds is sufficient to reduce the standard deviations by at least a third. The rates of increase for CO and CO2 were adjusted accordingly, for the case of filtered data using a 10-sec moving average, were 0.05 ppm/sec and 8.0 ppm/sec, respectively. The rate of increase for smoke remained unchanged since the signal from the smoke detector was relatively noise-free.

The length of the time window can be made to vary depending on the noise level in the measurements. An initial standard deviation is computed for a data set over a specified time history. Then, the standard deviation of the moving-averaged data over a specified time window is computed over the specified time history. The time window can be stepped in an increment of 5 seconds or more, and the standard deviations are compared. The best length of the time window is chosen when the standard deviation at the specified time window is only a fraction of the initial standard deviation of the unfiltered data. The length of the time window and the predetermined threshold rates can be selected to provide the degree of sensitivity needed for the particular application.

In a preferred embodiment, the fire alarm algorithm is specifically tuned to reduce or eliminate false alarms generated by smoke detectors. If the rate of increase for smoke exceeds its predetermined threshold rate, then the rates of increase of CO and CO2 are checked. And, if either the rate of increase of CO or CO2 exceeds its predetermined threshold rate, then the fire alarm is initiated. The alarm algorithm reads ((CO_Alarm+SMOKE_Alarm=2) OR (CO2_Alarm+SMOKE_Alarm=2)). CO_Alarm, CO2_Alarm and SMOKE_Alarm are all set to 0 (zero) initially, and set to 1 (one) when their corresponding rate of increase exceeds the predetermined threshold rates.

In an alternative embodiment, the fire alarm method is a more generalized approach to fire detection. The rates of increase for smoke, CO, and CO2 are all checked simultaneously. If at least two of the rates of increase exceed their predetermined threshold rates, then the fire alarm is initiated. The alarm algorithm reads (CO_Alarm+CO2_Alarm+SMOKE_Alarm≧2). This algorithm is important for fire scenarios where smoke production is not noticeable by the smoke detector, but productions of CO and CO2 are present. Such a fire scenario was seen in an experiment using a methanol pool fire where the smoke detector did not detect any increase in the level of smoke. However, in a practical environment, smoke will be eventually generated by burning materials other than the fire generating source.

An experimental test of the fire detection system incorporating the fire alarm algorithm of the first preferred embodiment was undertaken. Fires ranging from smoldering to flaming are generated to test the performance of the fire alarm algorithm. Representative materials include samples of HDPE beads, PVC clad wire, plastics pellets, fabric mixture (green canvas), and cotton. Liquid fuels included methanol, heptane and toluene. Methods of ignition included using a lighter, pilot flame, and hot coil. The fire alarm algorithm is able to detect fires in cases where the smoke detector did not even alarm; that is the smoke signal did not exceed 5 volts. Furthermore, in cases where the smoke detector did alarm, the fire alarm algorithm detected the fires at much earlier times. In all smoldering cases, the fire alarm algorithm of (CO_Alarm+SMOKE_Alarm=2) was triggered. This is in agreement with the fact that CO and smoke concentration rise during the smoldering process. In flaming fires, CO, CO2 and smoke concentrations play important roles in the detection of fires. In most cases, these three concentrations rise at the same time.

The typical nuisance sources found in aircraft cargo compartments are used to assess the robustness of the fire alarm algorithm. The nuisances included vapors of water, methanol, ethanol, acetone, ammonia, dry ice, insecticide bomb, automobile exhaust, and halon. CO2 was easily detected from the gasoline-burning automobile when the engine is idling, but CO and smoke were not present. When the engine was accelerated the levels of CO and CO2 increased, but particulate remains low. In both cases, no false alarm was generated. Exhaust from diesel-burning vehicles at airports contains more particulate than those burning gasoline; this could potentially cause a false alarm during ground operations with cargo doors open. Insecticide bombs are routinely used in aircraft cargo compartments on certain overseas flight to avoid spreading agricultural pests. The bomb caused a large signal on the smoke detector, but no noticeable rise in the CO and CO2 signals. On the contrary, dry ice generated rise in the CO2 signals, but no significant rise in the smoke and CO signals. These nuisance sources generated no false alarm. Combination of dry ice and insecticide could generate a false alarm. However, the initiation of an insecticide bomb in flight is an unlikely scenario, but dry ice will be present in most flights for refrigeration purposes. Of the vapors tested, a small interference between methanol and CO2 was observed. High methanol concentrations could make the instrument susceptible to false alarms, but this may reduce the real hazards associated with high concentrations of this flammable vapor. More significantly is the observation that the laser throughput drops dramatically as a result of broad-band absorption by the halon mixture (halons 1301 and 1211). The decrease in concentration measurements from neat halon is so severe that CO and CO2 concentrations could not be measured. Because halon 1301 is used onboard aircraft to suppress fires, it will be present after a fire is detected. The ability of the fire sensor system to continuously monitor the cargo compartments after extinguishing agents have been released would be compromised. For each of the nuisance sources tested, there was no interference with both smoke and trace gas. As a consequence, no false alarms were generated by any of these sources alone. The fire alarm algorithm is immune to possible nuisance sources that are found in-flight. However, possible false alarm could be generated during routine ground operations. Since the cargo compartments are open during ground operations, visual checks can be conducted to confirm cases of fire alarm being initiated.

Another method that could further strengthen the fire alarm algorithm against false alarms is to monitor the rates of increase over a specified period of time after it has exceeded the predetermined threshold rates over the time window of the moving-averaged data. When the rates of increase, computed over a shorter time period (a few seconds) than the time window of the moving-average, continues to exceed the threshold rates over the specified period of time (a few seconds after the initial indication of a fire), then the alarm for the fire signature under consideration can be set off (e.g., setting CO_Alarm=1). The rates of increase that are computed over the shorter period of time use measurement data that are also moving-averaged over that same period of time.

The fire detection system can incorporate an audible or visual signal to warn the operator (e.g., pilot) of impending fire danger in the environment being monitored. In the case of an airplane, a visual and audible warning can be strategically placed in the cockpit to warn the pilot of potential fires in the cargo compartments.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A method of detecting fires, the method comprising the steps of:

detecting levels of carbon monoxide, carbon dioxide, and smoke in an ambient environment;

computing over time rates of increase of each of the levels; and generating an alarm if one or more of the rates of increase exceed predetermined threshold rates of increase.

2. The method of claim 1 wherein the computing step comprises computing moving averages of one or more of the levels over a time window.

3. The method of claim 1 wherein the computing step comprises employing linear regression fitting.

4. The method of claim 1 wherein the detecting step comprises employing one or more of Fourier-transform infrared spectroscopy, non-dispersive infrared spectroscopy, electrochemical sensing, and diode laser spectroscopy.

5. The method of claim 4 wherein the detecting step comprises employing diode laser spectroscopy for detecting one or both of the levels of carbon monoxide and carbon dioxide.

6. The method of claim 4 wherein the detecting step comprises employing one or more multiple pass optical cells.

7. The method of claim 4 wherein the detecting step comprises employing one or more distributed feedback diode lasers.

8. The method of claim 4 wherein the detecting step comprises employing one or more vertical cavity surface emitting lasers.

9. The method of claim 1 wherein the detecting step detects carbon monoxide levels with a sensitivity of at least 5 ppm.

10. The method of claim 1 wherein the detecting step comprises employing for one or both of carbon monoxide and carbon dioxide levels least square fitting a measured spectrum to a model.

11. The method of claim 10 wherein the model includes a quadratic background.

12. The method of claim 1 wherein the generating step comprises generating an alarm if two or more of the rates of increase exceed predetermined threshold rates of increase.

13. The method of claim 1 wherein the generating step comprises generating an alarm if the rate of increase of smoke exceeds a predetermined threshold rate of increase and one or both of the other rates of increase exceeds the corresponding predetermined threshold rate of increase.

14. An apparatus for detecting fires, said apparatus comprising:

one or more detectors detecting levels of carbon monoxide, carbon dioxide, and smoke in an ambient environment;

a processor computing over time rates of increase of each of the levels; and an alarm system triggered if one or more of the rates of increase exceed predetermined threshold rates of increase.

15. The apparatus of claim 14 wherein said processor computes moving averages of one or more of the levels over a time window.

16. The apparatus of claim 14 wherein said processor employs linear regression fitting.

17. The apparatus of claim 14 wherein one or more of said one or more detectors employs one or more of Fourier-transform infrared spectroscopy, non-dispersive infrared spectroscopy, electrochemical sensing, and diode laser spectroscopy.

18. The apparatus of claim 17 wherein one or more of said one or more detectors employs diode laser spectroscopy for detecting one or both of the levels of carbon monoxide and carbon dioxide.

19. The apparatus of claim 17 wherein one or more of said one or more detectors employs one or more multiple pass optical cells.

20. The apparatus of claim 17 wherein one or more of said one or more detectors employs one or more distributed feedback diode lasers.

21. The apparatus of claim 17 wherein one or more of said one or more detectors employs one or more vertical cavity surface emitting lasers.

22. The apparatus of claim 14 wherein one or more of said one or more detectors detects carbon monoxide levels with a sensitivity of at least 5 ppm.

23. The apparatus of claim 14 wherein one or more of said one or more detectors employs for one or both of carbon monoxide and carbon dioxide levels least square fitting a measured spectrum to a model.

24. The apparatus of claim 23 wherein said model includes a quadratic background.

25. The apparatus of claim 14 wherein said alarm system generates an alarm if two or more of the rates of increase exceed predetermined threshold rates of increase.

26. The apparatus of claim 14 wherein said alarm system generates an alarm if the rate of increase of smoke exceeds a predetermined threshold rate of increase and one or both of the other rates of increase exceeds the corresponding predetermined threshold rate of increase.

* * * * *